US006484806B2

(12) United States Patent
Childers et al.

(10) Patent No.: US 6,484,806 B2
(45) Date of Patent: Nov. 26, 2002

(54) METHODS AND APPARATUS FOR HYDRAULIC AND ELECTRO-HYDRAULIC CONTROL OF SUBSEA BLOWOUT PREVENTOR SYSTEMS

(75) Inventors: Mark Childers, Spring, TX (US); Michael Cunningham, Houston, TX (US)

(73) Assignees: Atwood Oceanics, Inc., Houston, TX (US); Oceaneering, Houston, TX (US)

( * ) Notice: Subject to any disclaimer, the term of this patent is extended or adjusted under 35 U.S.C. 154(b) by 12 days.

(21) Appl. No.: 09/774,479

(22) Filed: Jan. 30, 2001

(65) Prior Publication Data

US 2002/0100589 A1 Aug. 1, 2002

(51) Int. Cl.[7] ..... E21B 29/12; E21B 34/06

(52) U.S. Cl. ..... 166/351; 166/363; 166/373; 251/1.1; 251/30.01

(58) Field of Search ..... 166/363, 364, 166/373, 351, 368; 137/560, 825, 635, 554, 557; 251/1.1, 1.3, 30.01

(56) References Cited

U.S. PATENT DOCUMENTS

| | | | | | |
|---|---|---|---|---|---|
| 3,250,336 | A | | 5/1966 | Hacher et al. | |
| 3,319,923 | A | | 5/1967 | Hacher et al. | |
| 3,516,491 | A | * | 6/1970 | Lewis | 166/336 |
| 3,865,142 | A | | 2/1975 | Begun et al. | |
| 3,894,560 | A | | 7/1975 | Baugh | |
| 3,921,500 | A | * | 11/1975 | Silcox | 166/338 |
| 4,052,703 | A | * | 10/1977 | Collins et al. | 166/351 |
| 4,095,421 | A | | 6/1978 | Silcox | |
| 4,174,000 | A | * | 11/1979 | Milberger | 137/236.1 |
| 4,351,261 | A | * | 9/1982 | Shanks | 114/264 |
| 4,378,848 | A | * | 4/1983 | Milberger | 166/351 |
| 4,384,612 | A | * | 5/1983 | Bradford et al. | 137/554 |
| 4,487,150 | A | * | 12/1984 | Shanks | 114/264 |
| 4,497,369 | A | * | 2/1985 | Hurta et al. | 166/368 |
| 4,509,405 | A | * | 4/1985 | Bates | 251/1.2 |
| 4,565,349 | A | | 1/1986 | Tomlin | |
| 4,630,680 | A | | 12/1986 | Elkins | |
| 4,687,179 | A | * | 8/1987 | Smith | 251/56 |
| 4,840,346 | A | | 6/1989 | Adnyana | |
| 4,880,025 | A | | 11/1989 | McMahan | |
| 5,070,904 | A | | 12/1991 | McMahan | |
| 5,398,761 | A | | 3/1995 | Reynolds | |
| 5,794,701 | A | | 8/1998 | Cunningham et al. | |
| 6,032,742 | A | | 3/2000 | Tomlin et al. | |
| 6,161,618 | A | | 12/2000 | Parks et al. | |

FOREIGN PATENT DOCUMENTS

| | | | |
|---|---|---|---|
| JP | 1-131785 | * | 5/1989 |

* cited by examiner

*Primary Examiner*—Robert E. Pezzuto
*Assistant Examiner*—Thomas A. Beach
(74) *Attorney, Agent, or Firm*—Streets & Steele; Jeffrey L. Streets

(57) ABSTRACT

An apparatus for controlling a blowout preventer stack. The apparatus comprises a control pod having a plurality of direct operated solenoid valves in electronic communication with a surface controller through one or more dedicated electronic control wires. The solenoids translate electronic control signals from the controller into hydraulic control signals that are in communication with a hydraulically operated pilot valve to cause delivery of hydraulic fluid from a power fluid source to a critical function of the blowout preventer stack (i.e., closing of a blowout preventer). The system also provides a plurality of hydraulically operated pilot valves that deliver hydraulic fluid from a power fluid source to a non-critical function of the blowout preventer stack upon receiving a hydraulic control signal directly from the controller through the umbilical.

33 Claims, 6 Drawing Sheets

METHODS AND APPARATUS FOR HYDRAULIC AND ELECTRO-HYDRAULIC CONTROL OF SUBSEA BLOWOUT PREVENTOR SYSTEMS

BACKGROUND OF THE INVENTION

1. Field of the Invention

The present invention relates to methods and apparatus using a combination of hydraulic and electro-hydraulic control of a subsea blowout preventer (BOP) system.

2. Description of the Prior Art

Safety considerations in offshore drilling activities dictate that a subsea BOP must be able to rapidly close the well bore regardless of water depth at the drilling location. Conventional hydraulic BOP control systems experience unacceptable delays in operating subsea BOP functions in deep water applications because the time required to send a hydraulic activation signal through an umbilical hose from the surface control station to the subsea pilot control valve becomes excessively long in deep water. Additionally, delivery of sufficient quantities of pressurized operating fluid to the BOP function from the surface requires a substantial amount of time. These two elements of a complete BOP sequence time are usually referred to as signal time and fill-up time, respectively.

Existing methods for reducing signal time have included increased hose sizing and higher operating pressure, while fill-up time has been minimized through the use of subsea fluid storage accumulators to effectively reduce the distance some of the fluid must flow before reaching the BOP. The adequacy of these methods has been challenged by the desire to drill in waters more than 5,000 feet deep where conventional systems have drawbacks. Large diameter hose bundles in long lengths require substantial deck space for storage and pose running and retrieval handling difficulties. Also, the usable subsea accumulator volume diminishes with increasing water depth because of external hydrostatic pressure effects, thus forcing more accumulator bottles to be installed subsea as the water depth increases.

Although multiplex electric BOP control systems are known in the art, such systems are very expensive and complex. However, in order to drill in deeper water without experiencing reaction time problems, operators have found it necessary to replace existing hydraulic control systems with the more complex, more expensive multiplex electric BOP control systems. This is especially the case in ultra-deep water that is more than 5,280 feet deep.

Therefore, there remains a need for a BOP control system that can be used in deep waters without the slow communication of all-hydraulic systems or the complexity or unreliability of multiplex electric systems. It would be desirable if the BOP control system could be retrofitted to existing hydraulic control systems with minimal equipment modifications and installation onboard the drilling rig. It would be further desirable if the subsea portion of the control system were easily retrievable.

SUMMARY OF THE INVENTION

The present invention provides an apparatus for controlling a blowout preventer stack. The system includes a surface controller for transmitting hydraulic control signals and electronic control signals and one or more umbilical cables comprising a plurality of hydraulic control lines and a plurality of dedicated electronic control wires that extend from the controller to an umbilical junction plate. One or more retrievable control pod assemblies are provided with a pod junction plate that is selectively mateable to the umbilical junction plate The control pod comprises a plurality of direct operated solenoid valves in electronic communication with the controller through one or more of the dedicated electronic control wires. Each solenoid valve translates electronic control signals, such as application of 24 volts, from the controller into hydraulic control signals that are in communication with a hydraulically operated pilot valve to cause delivery of hydraulic fluid from a power fluid source to a critical function of the blowout preventer (i.e., closing of the blowout preventer). A suitable power fluid source includes, but is not limited to, an accumulator, an auxiliary hydraulic supply line, a dedicated hydraulic line in the umbilical, an auxiliary conduit on a riser, or combinations thereof The system also provides a plurality of hydraulically operated pilot valves deliver hydraulic fluid from a power fluid source to a non-critical function of the blowout preventer upon receiving a hydraulic control signal directly from the controller through the umbilical. The system is preferably retrievable and does not include a multiplexer. It is preferred that the hydraulically operated control valves for critical functions do not receive a hydraulic control signal directly from the controller. The pod junction plate is selectively mateable with the umbilical junction plate under water, for example by a remote operated vehicle or a guide wire. Critical functions may be selected from, without limitation, the closing mode of one or more shear ram BOPs, the closing mode of one or more pipe ram BOPs and the closing mode of one or more annular type BOPs. Critical functions may include any other function considered essential in containing a kick or blowout from the well during drilling operations. The systems of the present invention are uniquely suited for operating in water of any depths, including water more than 5,000 feet deep, without requiring complex multiplexing technology.

BRIEF DESCRIPTION OF THE DRAWINGS

These and other objects, features and advantages of the present invention will become apparent from the detailed specification read in conjunction with the drawings.

DESCRIPTION OF THE PREFERRED EMBODIMENT

Figure 1:
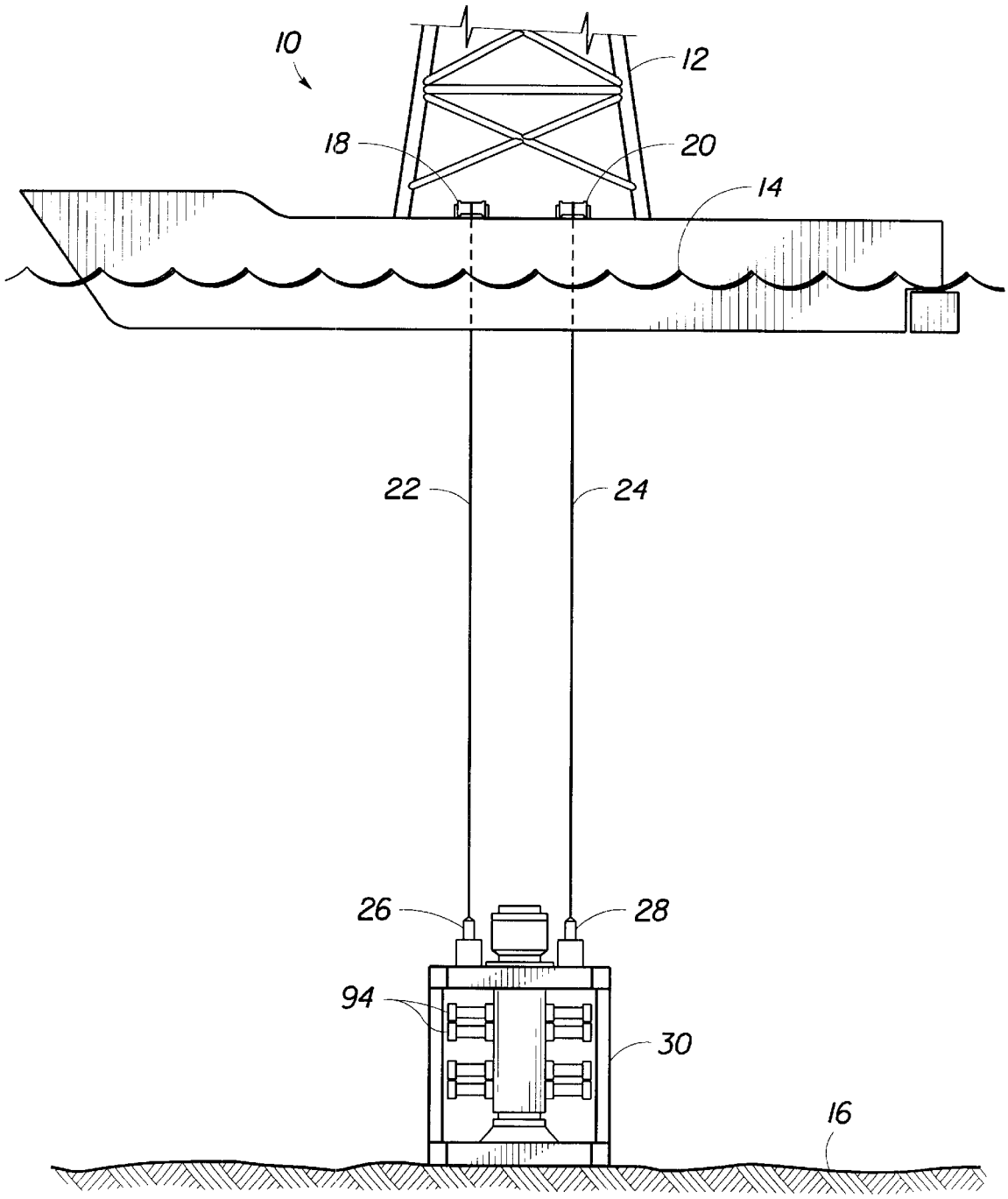
FIG. 1 is a schematic view of a mobile offshore drilling unit (MODU) in communication with a subsea BOP system.

The present invention provides a system that extends the depth capability of a hydraulic BOP control system by means of electric signal conversion equipment fitted to certain functions of the subsea BOP system. The invention contemplates the conversion of an existing hydraulic control system to one in which selected critical functions are controlled by electrical lines or wires, while leaving the non-critical functions to be controlled by the hydraulic lines or hoses. Defined as "critical" are those BOP functions considered essential in containing a kick or blowout from the well during drilling operations. Functions satisfying this criteria will vary with the particular BOP equipment onboard, but typically include the shear ram BOP, multiple sets of pipe ram BOPs, and one or two annular type BOPs. Critical functions may also include at least one pair of choke and kill valves and/or the marine riser lower disconnection device depending upon operator preference. The use of electrical signaling techniques for critical functions can eliminate hydraulic signal delay altogether, with the result that the operation time of critical BOP functions can be reduced to actual fill-up time which is presently well within prescribed time limits regardless of water depth. The signal delay that is experienced by all-hydraulic control systems and backup hydraulic control systems is unacceptable at subsea depths ranging between 4,000 and 5,500 feet or greater.

Electro-hydraulic conversion involves the addition of electrical/electronic control components to existing piloted hydraulic control systems in such a manner as to enable critical BOP functions to be actuated electrically in lieu of the existing hydraulic pressure activation techniques. Such conversions can allow for the continued use of existing hydraulic control hardware, most importantly including the subsea hydraulic control pod. The additional conversion components include a surface electrical power supply with fault protection and operator safety appliances, dedicated electrical control wires for each critical function, deployment reels, and subsea electric solenoid valves in an electronic control pod designed for mounting on or near existing hydraulic control pods. A particularly preferred embodiment also includes an umbilical that integrates the hydraulic hoses and electrical wires.

Unlike conventional electro-hydraulic BOP control systems, the electro-hydraulic conversion of the present invention limits the electrical control capability to "critical" BOP functions only and the electro-hydraulic system packaging specifically facilitates add-on conversion of hydraulic control systems. Limiting the electronic control to critical functions reduces the size and number of dedicated wires in the umbilical and eliminating the use of a multiplexer reduces the size and complexity of the surface power supply equipment and the subsea electric solenoid valve packages. The simplicity and reliability of the present invention allows the system to be used at depths below 5,000 feet and still be retrievable by guide wire or a remotely operated vehicle. The dedicated electrical wires also provide response times for critical functions that are just as fast as multiplex systems.

FIG. 1 illustrates a mobile offshore drilling unit (MODU) 10 having a conventional drilling rig 12 in the water 14 for drilling a conventional well into the sea floor 16. Located on the MODU 10 is a pair of redundant reels 18 and 20, connected, respectively, through the umbilicals 22 and 24, to a pair of control pod assemblies 26 and 28 mounted on a BOP stack 30 having a plurality of BOP actuators 94.

Figure 2:
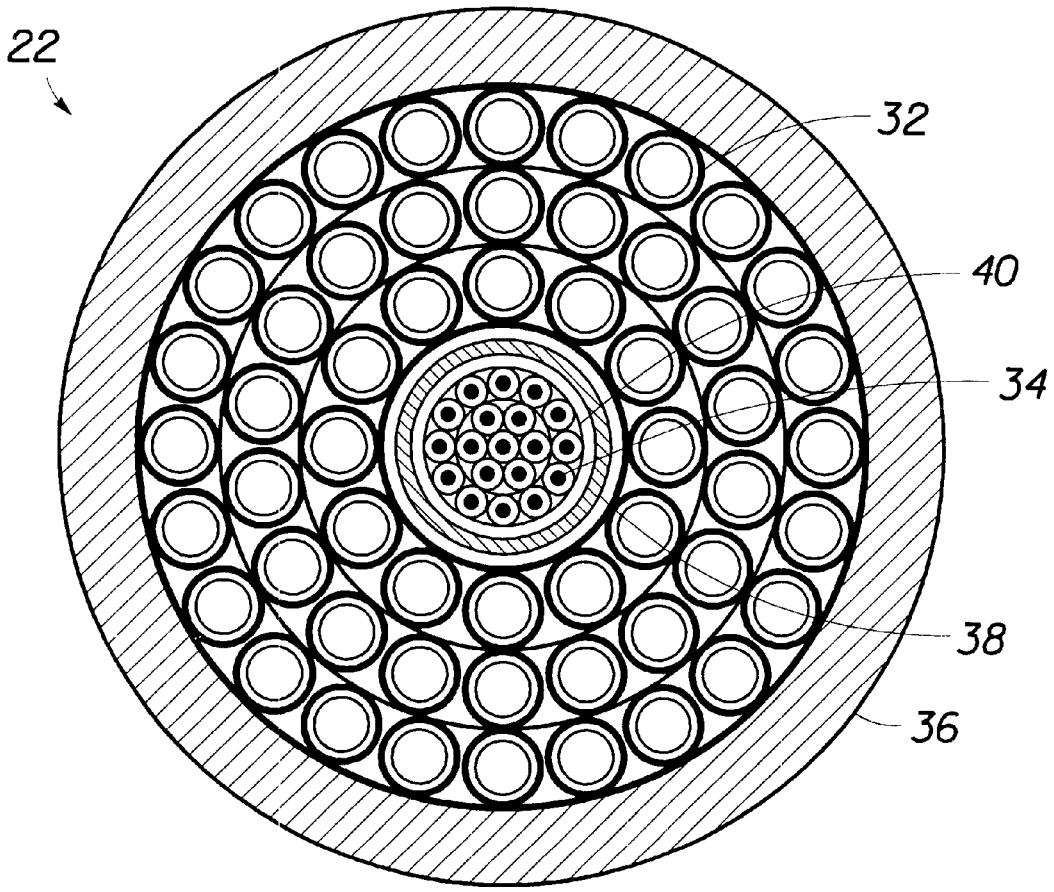
FIG. 2 is a cross-sectional view of an umbilical having both hydraulic hoses and dedicated electrical wires.

FIG. 2 is a cross-sectional view of the umbilical 22 having a combination of Kevlar reinforced thermoplastic hydraulic hoses 32 and electrical conductor wires 34. In a preferred embodiment, the umbilical 22 has a sheath 36 around the hydraulic hoses 32, and a reinforcing layer 38 and nylon tape 40 between the hoses 32 and wires 34. The electrical conductor wires 34 are preferably stranded copper wire, not coaxial wire. While the umbilical 22 is preferred, it is also possible within the scope of the present invention to use an electrical wire umbilical that is separate from the hydraulic umbilical.

Figure 3A:
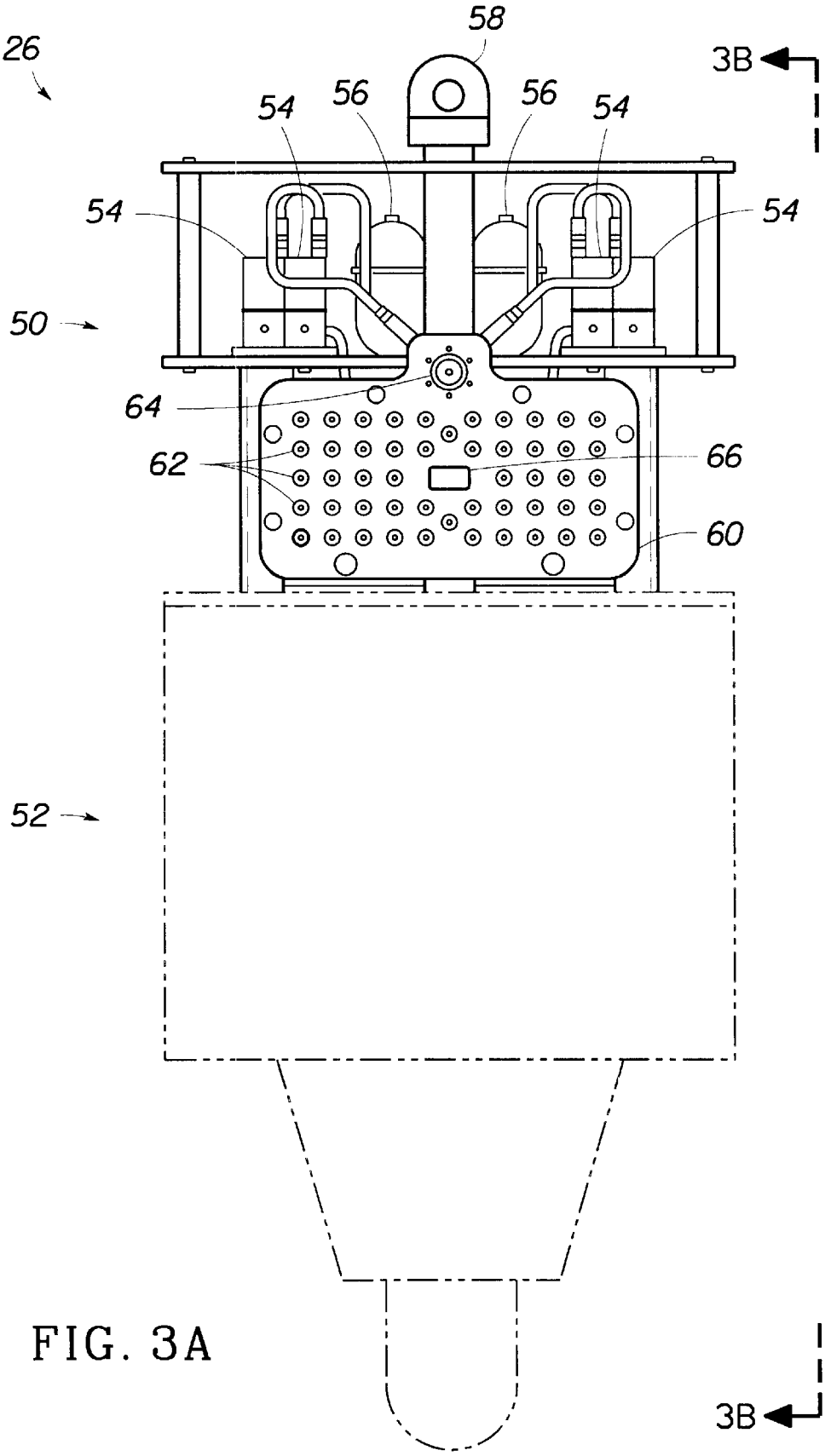
FIGS. 3A–C are side, face and top views of a control pod assembly having both an electronic control pod and a hydraulic control pod, along with the umbilical junction plate.
Figure 3B:
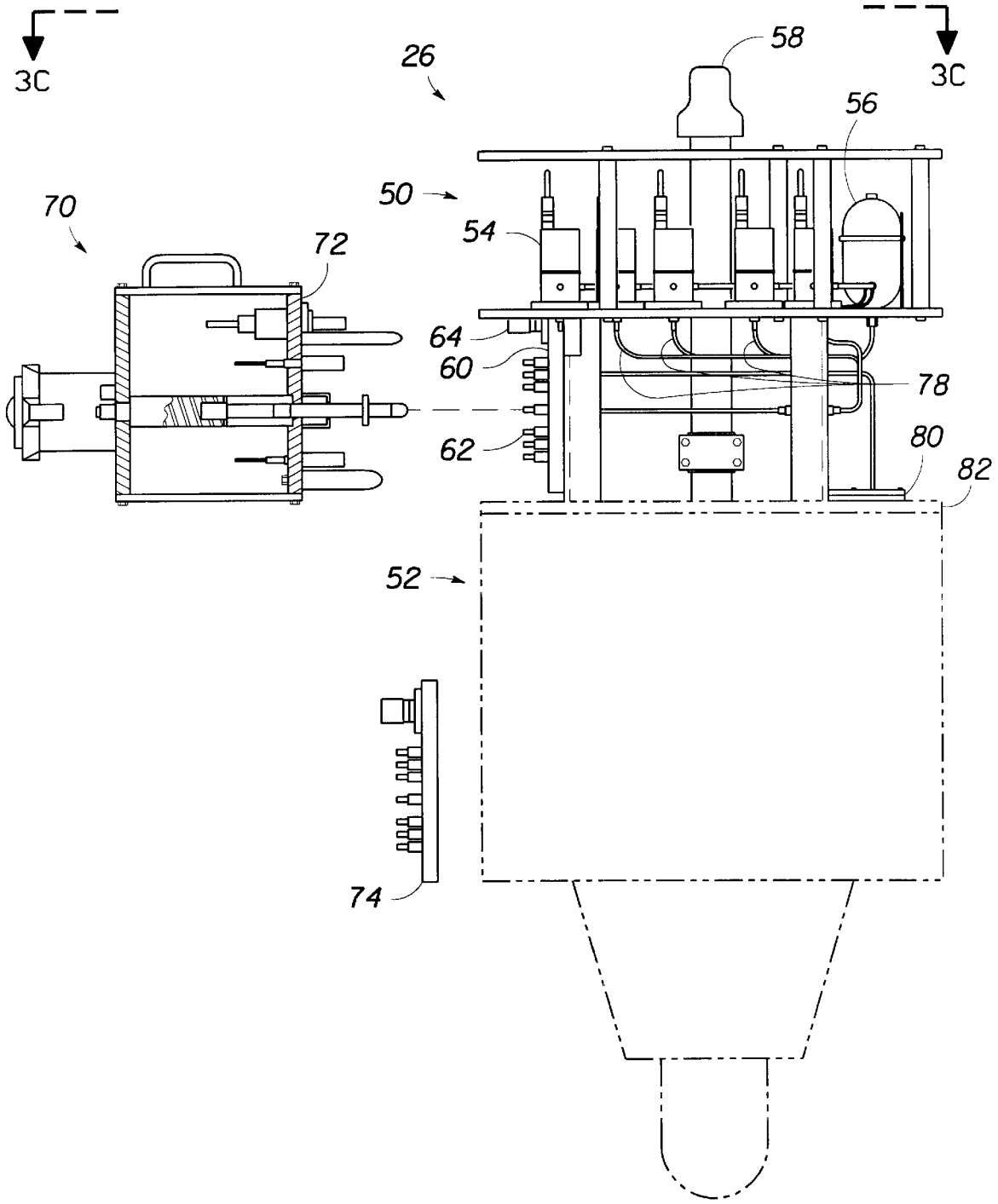
Figure 3C:
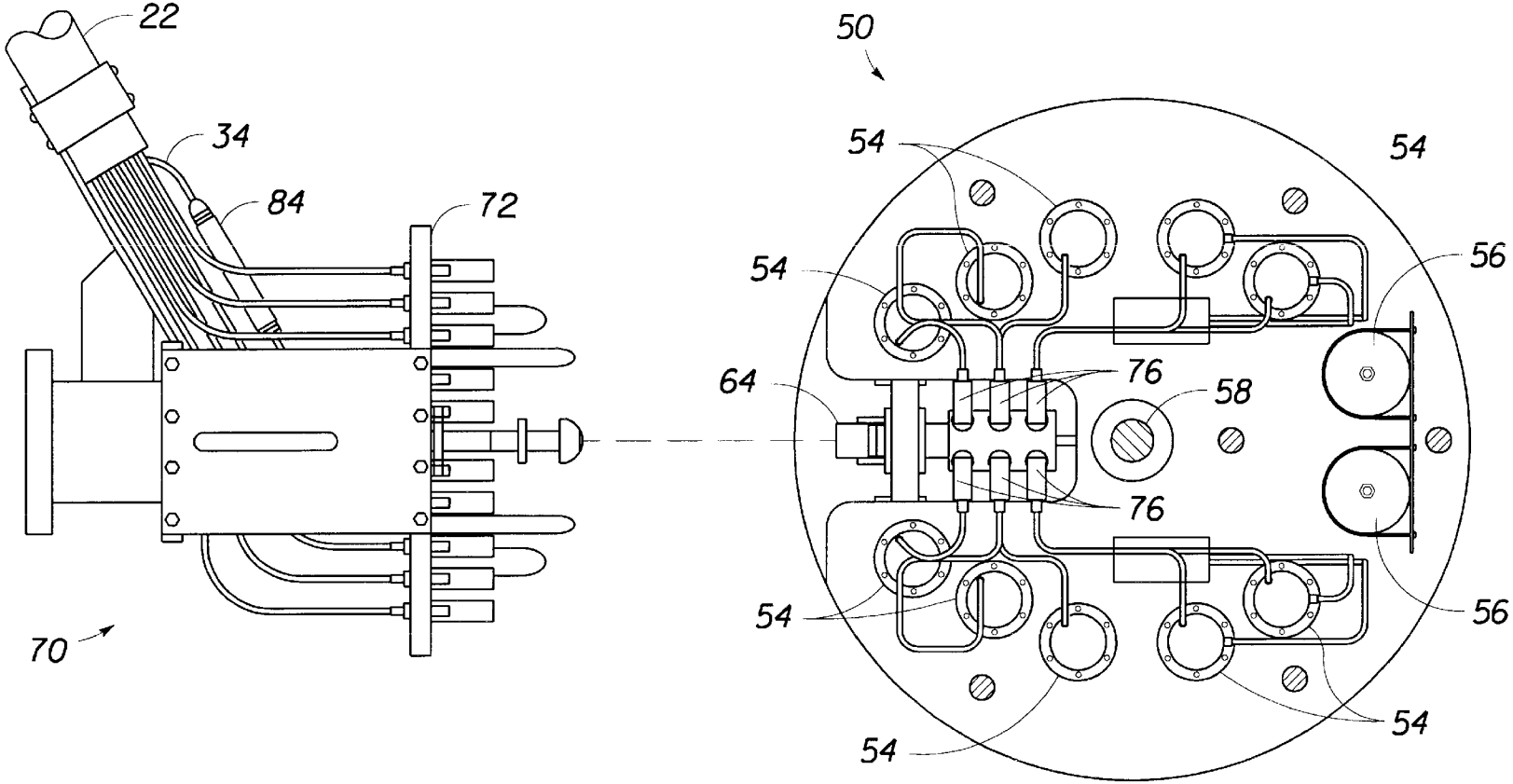

FIGS. 3A–C arc side, face and top views of a control pod assembly 26 having both an electronic control pod 50 and a hydraulic control pod 52, along with the umbilical junction plate assembly 70. In FIG. 3A, the electronic control pod 50 is shown having solenoid valves 54, accumulators 56, an extension latch rod 58 for ROV detachment of the pod 52 from the BOP stack 30 (See FIG. 1), and a junction plate 60. The junction plate is designed for mating with an umbilical junction plate, and includes hydraulic line connections 62 and an electrical line connector 64 having multiple electrical connections therein. The junction plate is shown as a female junction plate having female connectors or couplings 62, 64 and also a female connector 66 for ROV attachment and detachment of the umbilical junction plate, which method and apparatus are discussed further below.

FIG. 3B illustrates the alignment of the male umbilical junction plate 72 with the female junction plate 60. Upon connection, the junction plates 72, 60 will provide fluid communication between the hydraulic hoses 32 of the umbilical 22 and the connectors 62 and electronic communication of between the electrical wires 34 of the umbilical and the electrical connector 64. A parking plate 74 is also provided for securing the umbilical junction plate 72 during maintenance, attachment or detachment of the electrical pod 50, the hydraulic pod 52, or both.

As shown most clearly in FIG. 3C, the electrical connector 64 is in communication with the multiple dedicated control wires 34 from the umbilical 22 and hardwires the electrical signals through dedicated wires 76 to the solenoids 54, preferably about ten solenoid units for operation of ten functions, where a "function" is a single action such as the closing of a BOP or opening of a BOP. The solenoid valves 54 are in fluid communication with the accumulators 56 to pass hydraulic control signals through lines 78 to the hydraulic control pod 52, which contain the pilot valves. Optionally, a junction plate 80 is provided to selectively mate the pod 50 with a junction plate 82 on the pod 52 to facilitate retrievability of the pod 50 that contains all of the electronics of the present system.

Because the umbilical provides dedicated wires for each function, there is no need for a multiplex controller, related circuitry, error-checking procedures and the like. The system provides electric pilot control for critical subsea functions that may be assigned according to the configuration of the BOP stack. For example, the functions may be assigned as the "Close" function of two annulars, four rams, and the like. The subsea control equipment can be mounted on 42-line, 60-line, or other conventional hydraulic control pods. All connections between the electrical control pod 50 and the hydraulic control pod 52 are hydraulic.

The mini-pod 50 utilizes the existing pod-mounted hydraulic junction plates 82 to interface the mini-pod 50 to the existing BOP control pod 52. The mini-pod assembly consists of a stainless steel structure in which are mounted ten direct solenoid operated control valves 54, for example to control five BOP open/close or latch/unlatch functions. These valves are controlled from the surface and will direct hydraulic fluid to the selected BOP function pilot valves (not shown). The hydraulic tubing within the mini-pod is preferably all stainless steel, or pressure-compensating tubing with the electrical wire therein.

The subsea umbilical junction plate 72 utilizes stainless steel self-sealing hydraulic couplers and an underwater mateable electric connector with field installable and testable assembly (FITA) 84 to terminate the electric cable. The subsea umbilical junction plate (SUJP) 72 provides the means to terminate the control umbilical 22 on the lower marine riser package and to distribute the hydraulic and electric conductors to both the mini-pod for electrically piloted functions and the existing stack control module for direct hydraulic control. The SUJP is ROV operable allowing the umbilical to be remotely disconnected from the mini-pod for retrieval.

Figure 4:
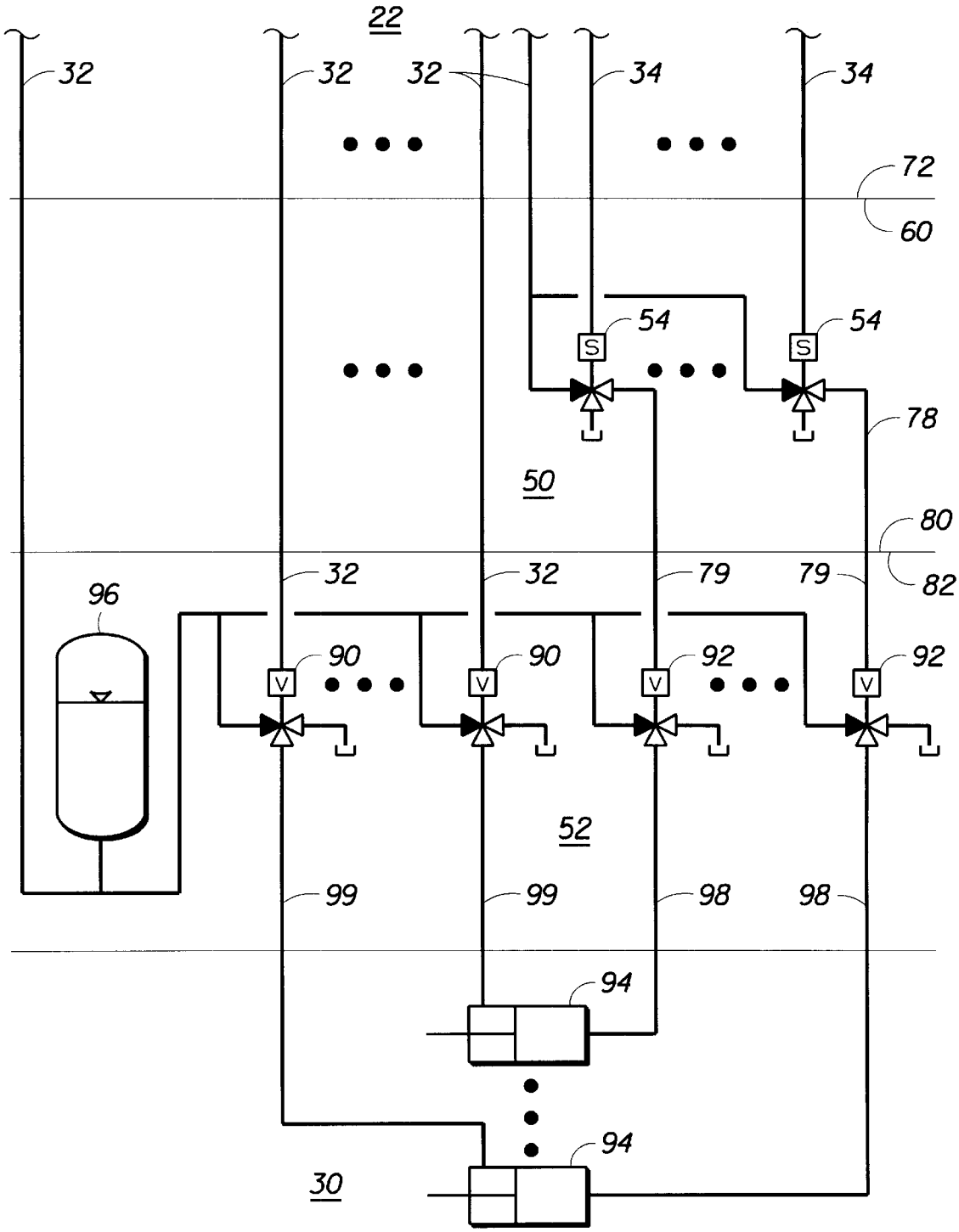
FIG. 4 is a schematic diagram of the umbilical, electronic control pod, hydraulic control pod, and critical/noncritical functions of a subsea blowout preventer.

FIG. 4 is a schematic diagram of the umbilical 22, electronic control pod 50, hydraulic control pod 52, and critical/noncritical functions, such as the close/open functions of a blowout preventer 94, of a subsea blowout preventer stack 30. Consistent with earlier figures, the umbilical 22 is shown having hydraulic hoses 32 and dedicated electrical wires 34 terminating in a junction plate 72. The plate 72 mates with junction plate 60 to communicate electrical control signals to the plurality of solenoids valves 54. As directed by the controller at the surface, the solenoid valves 54 pass a hydraulic control signal (pressure) through lines 78 to the junction plate 80. The plate 80 is, in turn, couples to the junction plate 82 to communicate hydraulic control signals through lines 79 to pilot valves 92 and through lines 32 to pilot valves 90.

Accordingly, the pilot valves 92 provide hydraulic fluid from a power fluid source, such as the accumulator 96 or an auxiliary supply conduit down the marine riser, to operate critical functions of the BOP stack. For example, the "close" side of the BOP hydraulic actuator 94 is shown in fluid communication with the outlet of the valves 92 through lines 98. In this manner, the length of hydraulic tubing involved in communicating the "close" command to the BOP actuator 94 is the distance between the valve 54 and the valve 92, which are adjacent each other and preferably within 1–5 feet from each other. Furthermore, the hydraulic tubing within the pods 50, 52 may be stainless steel or other substantially incompressible material so that time lags due to ballooning of the tube or compressibility of the fluid are minimal. In the present example, the "open" function of the BOP actuator 94 is deemed to be noncritical and does not utilize a dedicated electrical wire 34 or solenoid valve 54, but rather is operated by passing hydraulic hoses 32 directly to the pilot valves 90. Accordingly, the "open" side of the BOP hydraulic actuator 94 is shown in fluid communication with the outlet of the valves 90 through lines 99.

The underlying cause of excessive signal time or response time is the relatively large volumetric expansion characteristic of common hydraulic hose, and although improved low expansion hose is available, all presently available hydraulic hose exhibits poor signal response time performance from the presence of high glycol concentrations (40–50%) in the hydraulic fluid used during cold weather operations to prevent fluid freezing. The use of the electric signaling technique for critical functions can eliminate hydraulic signal time altogether with the result that the operation time of critical BOP functions can be reduced to actual fill-up time which is presently well within prescribed time limits regardless of water depth and temperature. When using an auxiliary supply conduit down the marine riser, it is possible to altogether eliminate the use of accumulators on the BOP or lower marine riser package.

Again, although the functions defined as "critical" may vary with the particular BOP equipment onboard, the critical functions will typically include the closing of the shear ram BOP(s), multiple sets of pipe ram BOPs, and one or two annular type BOPs. The critical functions may also include at least one pair of choke and kill valves and/or the marine riser lower disconnection device, if desired.

Although the invention contemplates the conversion of selected hydraulic functions to electro-hydraulic control, the invention also contemplates a system which, when new, utilizes hydraulic control of non-critical functions and which utilizes electro-hydraulic control of selected critical functions.

Unlike the BOP controller described by McMahon in U.S. Pat. No. 5,070,904, the modular control system of the present invention does not provide for a backup hydraulic control signal to operate the critical BOP functions. The electric controls having dedicated wires operating each solenoid valve are more reliable than multiplex systems and do not require a backup system. Furthermore, the absence of a multiplex electronics package makes the electronic control pod much simpler and smaller, and the absence of a backup system reduces the number of valves and connections in the hydraulic control pod.

The solenoid valves 54 and the hydraulically piloted valves 90, 92 are preferably 3-way, 2-position valves. In the absence of an electronic or hydraulic control signal (i.e., the fail safe position), the valves are closed to hydraulic fluid, while providing the fluid communication of the downstream device with a pressure vent. Upon receiving a control signal, the valves provide fluid communication of the hydraulic fluid to downstream device, while closing off the vent.

The junction plate connection between the umbilical and the mini-pod, as well as the junction plate connection between the mini-pod and the existing hydraulic control pod, is preferably achieved using mating male and female junction plates. The most preferred connection is disclosed in U.S. Pat. No. 5,794,701, which patent is incorporated by reference herein. Basically, a female receptacle end is provided on the hydraulic control pod that has connections on it to the BOPs. The male end formed on the mini-pod has an orientation lug for rough orientation. Once the rough orientation is made, the male end is advanced into the female end and the shaft is rotated by an ROV for alignment of lugs with a detent. Once the lugs advance past the detent, they are rotated so that a segment of the shaft on the male end of the connection can no longer turn. Further rotational movements by the ROV on another portion of the shaft advances a plate that makes up the connection with all of the hydraulic couplings completed. A similar connection is made between the mini-pod and the umbilical so that the ROV can complete the connection between the many hydraulic and electrical couplings. It should be recognized that the electro-hydraulic umbilical may be run on guidelines or strapped to the marine riser.

Making use of the foregoing junction plate connections or similar connections, one or more pods of the system are retrievable with or without guidelines via the use of a remote operated vehicle (ROV). In the guidelineless mode, ROVs and a large winch are used to pull and run the pods. This means that the marine riser does not have to be pulled to do a repair. Use of the ROV also means that the umbilical can be disconnected or reconnected to the pod with the hydraulic pressure and electric current on or off. Furthermore, the system can be designed for retrieval of either the hydraulic portion or electrical portion separate from the other. Preferably, a purpose built ROV connection assembly is used to provide the electric and hydraulic connection between the mini-pod and the umbilical. This connection system will allow an ROV equipped with a standard ROV torque tool the ability to disconnect and park the removable junction plate of the umbilical to allow for an ROV assisted recovery of the mini-pod and/or hydraulic control pod assemblies. Where the electrical mini-pod is separately retrievable, an extension rod should be provided to extend the existing hydraulic pod release rod above the add-on mini-pod assembly in order for the rod to be accessible by the ROV.

While the foregoing is directed to the preferred embodiment of the present invention, other and further embodiments of the invention may be devised without departing from the basic scope thereof, and the scope thereof is determined by the claims that follow.

What is claimed is:

1. An apparatus for controlling a BOP stack, comprising:

(a) a surface controller for transmitting hydraulic control signals and electronic control signals;

(b) one or more umbilical cables comprising a plurality of hydraulic control lines and a plurality of dedicated electronic control wires that extend from the controller to an umbilical junction plate;

(c) one or more retrievable control pod assembly comprising:

(1) a pod junction plate that is selectively mateable to the umbilical junction plate;

(2) a plurality of direct operated solenoid valves in electronic communication with the controller through one or more of the dedicated electronic control wires, wherein each solenoid valve translates electronic control signals from the controller into hydraulic control signals that are in communication with a hydraulically operated pilot valve to cause delivery of hydraulic fluid from a power fluid source to a critical function of the BOP stack; and (3) a plurality of hydraulically operated pilot valves that deliver hydraulic fluid from a power fluid source to a non-critical-function of the BOP stack upon receiving a hydraulic control signal directly from the controller through the umbilical.

2. The apparatus of claim 1, wherein the system does not include a multiplexer.

3. The apparatus of claim 1, wherein the retrievable control pod does not include a multiplexer.

4. The apparatus of claim 1, wherein hydraulically operated pilot valves deliver hydraulic fluid from a power fluid source selected from an accumulator, an auxiliary hydraulic supply line, a dedicated hydraulic line, a conduit on a riser, or combinations thereof.

5. The system of claim 1, wherein the first plurality of hydraulically operated control valves do not receive a hydraulic control signal directly from the controller.

6. The apparatus of claim 1, wherein the pod junction plate is selectively mateable with the umbilical junction plate under water.

7. The apparatus of claim 6, wherein the pod junction plate is selectively mateable with the umbilical junction plate by a remote operated vehicle.

8. The apparatus of claim 1, wherein the control pod is retrievable by a remote operated vehicle or a guide wire.

9. The apparatus of claim 1, wherein the critical function is selected from the closing mode of one or more shear ram BOPs, the closing mode of one or more pipe ram BOPs and the closing mode of one or more annular type BOPs.

10. The apparatus of claim 1, wherein the critical functions are considered essential in containing a kick or blowout from the well during drilling operations.

11. The apparatus of claim 1, wherein each direct operated solenoid valve translates the electronic control signal into a hydraulic control signal by passing hydraulic fluid to a pilot valve upon receiving an electronic control signal from the controller.

12. The apparatus of claim 1, wherein the plurality of direct operated solenoid valves in electronic communication with the controller through one or more of the dedicated electronic control wires translates electronic control signals from the controller into hydraulic control signals that are in communication with a hydraulically operated pilot valve to cause delivery of hydraulic fluid from a power fluid source to a non-critical function of the BOP stack.

13. A kit for retrofitting a pre-existing all-hydraulic blowout preventer stack control pod to provide electronic control of critical functions, wherein the critical functions are controlled by hydraulically operated pilot valves, comprising:

(a) a surface controller for transmitting electronic control signals;

(b) an electronic control pod coupled to the all-hydraulic control pod;

(c) one or more umbilical cables comprising a plurality of dedicated electronic control wires that extend from the controller to the electronic control pod;

(d) wherein the electronic control pod comprises a plurality of direct operated solenoid valves in electronic communication with the controller through one or more of the plurality of dedicated electronic control wires, wherein each direct operated solenoid valve translates electronic control signals from the controller into hydraulic control signals that are in communication with a junction plate that is aligned for coupling with one of the hydraulically operated pilot valves controlling the critical function.

14. The kit of claim 13, further comprising:

(d) a pod junction plate that is selectively mateable to the umbilical junction plate.

15. The kit of claim 13, wherein the electronic control pod passes hydraulic control lines for operating a plurality of noncritical functions of the blowout preventer stack.

16. A method for retrofitting a preexisting all-hydraulic blowout preventer stack control pod to provide electronic control of a critical function previously controlled by a surface controller connected by a hydraulic control line to a hydraulically operated pilot valve, comprising:

replacing the hydraulic control line from the surface controller to the hydraulically operated pilot valve with a hydraulic control line from an outlet of a direct operated solenoid valve; and connecting an electronic control line to the direct operated solenoid valve from the surface controller, wherein the surface controller transmits electronic control signals through the electronic control line to the direct operated solenoid valve, and wherein the electronic control signal commands the direct operated solenoid valve to send a hydraulic control signal to the hydraulically operated pilot valve to cause delivery of hydraulic fluid from a power fluid source to the critical function of the blowout preventer stack.

17. The method of claim 16, wherein the electronic control signal to the direct operated solenoid valve is not multiplexed.

18. The method of claim 16, wherein the critical function is selected from the closing mode of one or more shear ram blowout preventers, the closing mode of one or more pipe ram blowout preventers, and the closing mode of one or more annular type blowout preventers.

19. The method of claim 16, wherein the critical functions are considered essential in containing a kick or blowout from the well during drilling operations.

20. The method of claim 16, further comprising:

mating a retrievable control pod to a blowout preventer stack, wherein the blowout preventer stack comprises a plurality of blowout preventer actuators.

21. The method of claim 16, further comprising:

maintaining hydraulic control lines from the surface controller in direct communication with hydraulically operated pilot valves associated with non-critical functions.

22. An apparatus for controlling a BOP stack, comprising:

(a) a surface controller for transmitting hydraulic control signals and electronic control signals;

(b) one or more umbilical cables comprising a plurality of control transmission carriers selected from hydraulic control lines, dedicated electronic control wires, and combinations thereof, wherein the control transmission carriers extend from the controller to an umbilical junction plate;

(c) one or more retrievable control pod assembly comprising:

(1) a pod junction plate that is selectively mateable to the umbilical junction plate;

(2) a plurality of direct operated solenoid valves in electronic communication with the controller through one or more of the dedicated electronic control wires, wherein each solenoid valve translates electronic control signals from the controller into hydraulic control signals that are in communication with a hydraulically operated pilot valve to cause delivery of hydraulic fluid from a power fluid source to a critical function of the BOP stack; and (3) a plurality of hydraulically operated pilot valves that deliver hydraulic fluid from a power fluid source to a non-critical function of the BOP stack upon receiving a hydraulic control signal directly from the controller through the umbilical.

23. A method for retrofitting a pre-existing all-hydraulic blowout preventer stack control pod to provide electronic control of critical functions previously controlled by a surface controller connected by hydraulic control lines to critical hydraulically operated pilot valves, comprising:

adapting the surface controller to transmit hydraulic control signals and electronic control signals through one or more umbilical cables to a retrievable control pod assembly;

adapting the one or more umbilical cables comprising a plurality of control transmission carriers selected from hydraulic control lines, dedicated electronic control wires, and combinations thereof, to extend the control transmission carriers from the controller to one or more umbilical junction plates;

replacing the hydraulic control lines from the surface controller to the critical hydraulically operated pilot valves with hydraulic control lines from outlets of a plurality of direct operated solenoid valves; and connecting the electronic control wires from the surface controller to the direct operated solenoid valves, wherein the surface controller transmits control signals through the electronic control wires to the direct operated solenoid valves, and wherein the electronic control signals command the direct operated solenoid; valves to send hydraulic control signals to the critical hydraulically operated pilot valves to cause delivery of hydraulic fluid from a power fluid source to the critical functions of the blowout preventer stack.

24. The method of claim 23, further comprising:

adapting an electronic control pod for coupling with the all-hydraulic control pod, wherein the all-hydraulic control pod coupled to the electronic control pod forms the retrievable control pod.

25. The method of claim 23, further comprising:

mounting within the retrievable control pod the plurality of direct operated solenoid valves in electronic communication with the surface controller through one or more of the dedicated electronic control wires.

26. The method of claim 23, further comprising:

adapting one or more pod junction plates on the retrievable control pod assembly for mating each of the one or more unbilical junction plates to the one or more pod junction plates, wherein each pod junction plate is adapted for mating with one of the umbilical junction plates.

27. The method of claim 23, wherein mating each of the one or more umbilical junction plates to the one or more pod junction plates comprises:

connecting the hydraulic control lines in the umbilical cable to corresponding hydraulic connectors in the control pod to provide fluid communication between the hydraulic control lines and the hydraulic connectors;

connecting the electrical wires in the umbilical cable to corresponding electrical connectors in the control pod to provide electronic communication between the electrical wires and the electrical connectors.

28. The method of claim 23, further comprising:

mating the retrievable control pod to a blowout preventer stack, wherein the blowout preventer stack comprises a plurality of blowout preventer actuators.

29. The method of claim 26, wherein the step of mating the retrievable control pod to a blowout preventer stack further comprises:

connecting hydraulic lines in the control pod to hydraulic lines to the blowout preventer actuators providing fluid communication between the hydraulic lines in the control pod and the hydraulic lines to the actuators.

30. The method of claim 23, wherein the electronic control signals to the direct operated solenoid valve are not multiplexed.

31. The method of claim 23, wherein the critical functions are selected from the closing mode of one or more shear ram blowout preventers, the closing mode of one or more pipe ram blowout preventers, and the closing mode of one or more annular type blowout preventers.

32. The method of claim 23, wherein the critical functions are considered essential in containing a kick or blowout from the well during drilling operations.

33. The method of claim 23, further comprising:

maintaining hydraulic control lines from the surface controller in direct communication with non-critical hydraulically operated pilot valves associated with non-critical functions.

* * * * *